US008329093B2

(12) United States Patent
Tschofen

(10) Patent No.: US 8,329,093 B2
(45) Date of Patent: Dec. 11, 2012

(54) METHOD FOR PREPARING METAL-MATRIX COMPOSITE AND DEVICE FOR IMPLEMENTING SAID METHOD

(75) Inventor: Jacques Tschofen, Bologne (FR)

(73) Assignee: Forges de Bologne, Bologne (FR)

( * ) Notice: Subject to any disclaimer, the term of this patent is extended or adjusted under 35 U.S.C. 154(b) by 1134 days.

(21) Appl. No.: 11/817,335

(22) PCT Filed: Mar. 14, 2006

(86) PCT No.: PCT/FR2006/000564
§ 371 (c)(1),
(2), (4) Date: Apr. 15, 2008

(87) PCT Pub. No.: WO2006/097622
PCT Pub. Date: Sep. 21, 2006

(65) Prior Publication Data

US 2008/0310989 A1 Dec. 18, 2008

(30) Foreign Application Priority Data

Mar. 14, 2005 (FR) ..... 05 02481

(51) Int. Cl.
*B22F 3/02* (2006.01)
*B22F 9/02* (2006.01)
*B22F 3/24* (2006.01)

(52) U.S. Cl. ..... 419/14; 419/10; 419/17; 419/28; 419/32; 419/38; 419/42; 419/48; 419/55; 266/114

(58) Field of Classification Search ..... 419/14
See application file for complete search history.

(56) References Cited

U.S. PATENT DOCUMENTS 3,740,210 A * 6/1973 Bomford et al. ..... 75/352
3,776,704 A 12/1973 Benjamin
4,000,235 A * 12/1976 Van Leemput ..... 264/109
4,104,061 A * 8/1978 Roberts ..... 419/29

(Continued)

FOREIGN PATENT DOCUMENTS

EP 0 175 548 3/1986

(Continued)

OTHER PUBLICATIONS

B. Lynn Ferguson and Randall German, "Powder Shaping and Consolidation Technologies," ASM Handbook vol. 7 (1998), pp. 313-320.*

(Continued)

*Primary Examiner* — Roy King
*Assistant Examiner* — Christopher Kessler
(74) *Attorney, Agent, or Firm* — Leydig, Voit & Mayer, Ltd.

(57) ABSTRACT

A method for preparing metal-matrix composites including cold-process isostatic compaction of previously mixed powders and hot-process uniaxial pressing of the resulting compact is disclosed. The method enables metal-matrix composites with improved properties to be obtained. A device for implementing isostatic compaction comprising a latex sheath into which the mixture of powders is poured, a perforated cylindrical container in which the latex sheath is arranged, and means for sealed insulation of the mixture of powders contained in the sheath is also disclosed.

15 Claims, 3 Drawing Sheets

U.S. PATENT DOCUMENTS

| | | | | | |
|---|---|---|---|---|---|
| 4,115,107 | A | | 9/1978 | Booz et al. | |
| 4,138,346 | A | * | 2/1979 | Nassry et al. | 508/250 |
| 4,435,213 | A | * | 3/1984 | Hildeman et al. | 75/249 |
| 4,615,735 | A | * | 10/1986 | Ping | 75/249 |
| 4,623,388 | A | | 11/1986 | Jatkar et al. | |
| 5,561,829 | A | | 10/1996 | Sawtell et al. | |

FOREIGN PATENT DOCUMENTS

| | | |
|---|---|---|
| WO | WO 98/00572 | 1/1988 |
| WO | WO 03/103879 | 12/2003 |

OTHER PUBLICATIONS

George Long, "Preventing Aluminum Powder Dust Cloud Explosions," Ind. Eng. Chem., 1961, 53 (10), pp. 823-825.*

Wikipedia entry for "stearic acid": (http://en.wikipedia.org/wiki/Stearic_acid) retrieved Nov. 8, 2011.*

E. Klar and C.B. Thompson, Powder Treatments and Lubrication, Shaping and Consolidation Technologies, vol. 7, Powder Metal Technologies and Applications, ASM International, 1998, p. 321-325. Retrieved from ASM Handbooks online Nov. 8, 2011.*

* cited by examiner

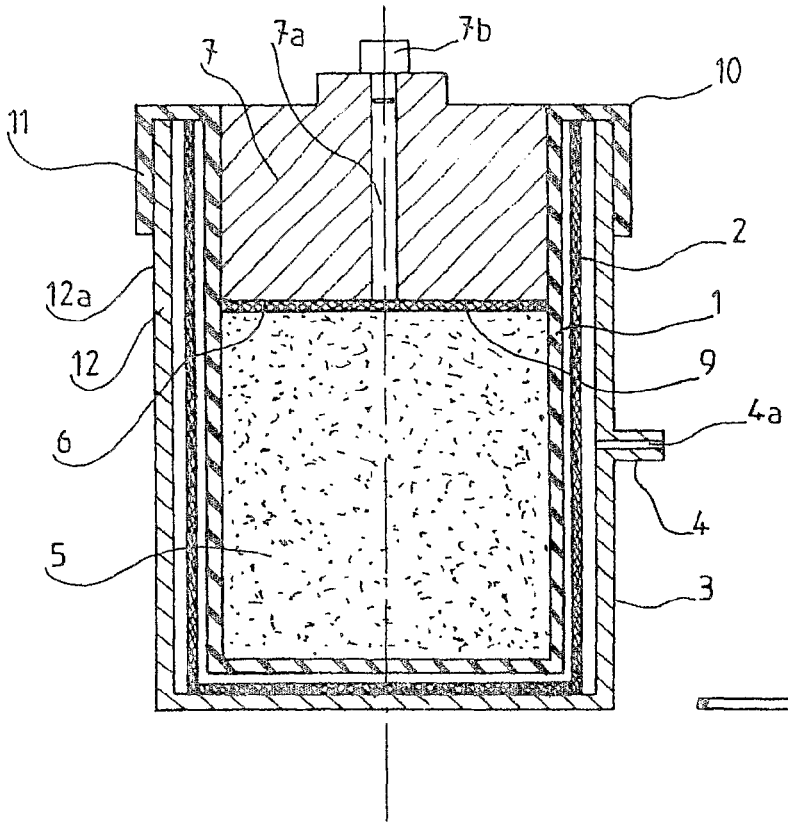
FIG. 2
FIG. 3
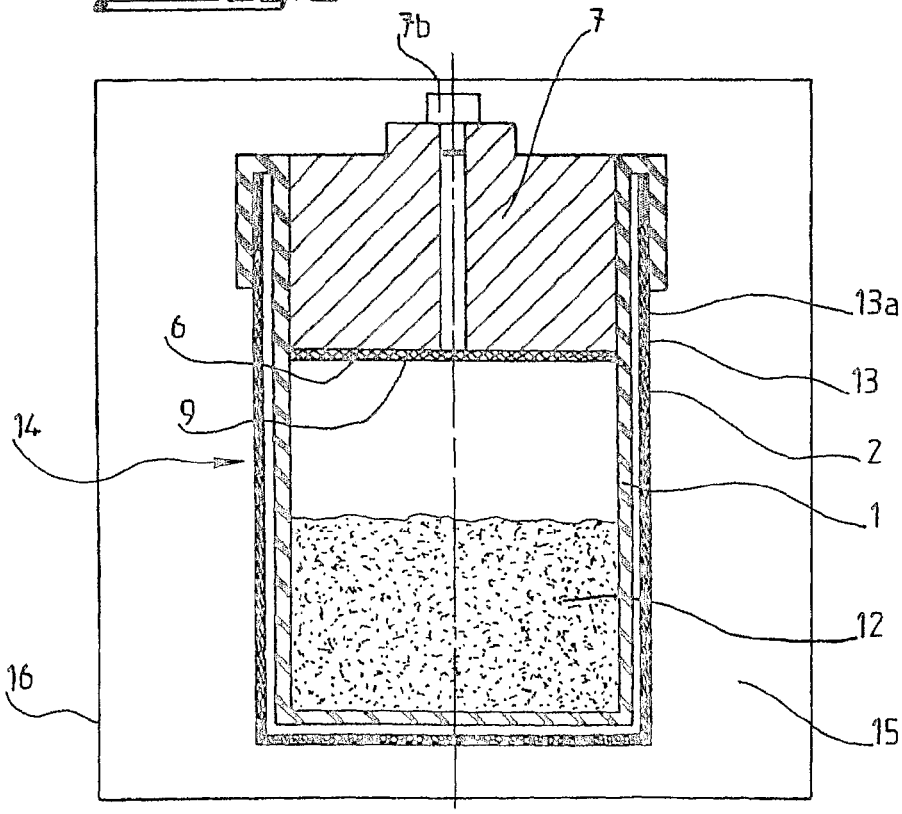

METHOD FOR PREPARING METAL-MATRIX COMPOSITE AND DEVICE FOR IMPLEMENTING SAID METHOD

FIELD OF THE INVENTION

The present invention relates to a process for preparation of metal-matrix composites (MMC).

The invention also relates to a device making possible the implementation of such a process.

CMMs can be aluminum alloys reinforced by particles such as, for example, particles of silicon carbide, boron carbide, alumina, or any other ceramic material.

CMMs are mainly used for manufacturing metallic parts in the field of aeronautics, such as rotor parts for helicopters.

The stamping of parts made of MMC is done using billets weighing several tens of kilos which are obtained by compaction of powders mixed beforehand.

In certain known processes, the main compaction step is done by uniaxial pressing leading to the formation of strata in the billets, which is disadvantageous for the mechanical properties of the metallic parts obtained from these billets.

In effect, it is necessary for each billet to have the most homogeneous possible distribution of the elements constituting it, and particularly of the reinforcing particles, so that the parts manufactured from these billets have the required mechanical properties.

Finally, simplicity of a process for manufacturing MMCs is necessary in order to limit the production costs of these MMCs.

SUMMARY OF THE INVENTION

The process of the invention makes it possible to ameliorate the aforementioned disadvantages and is essentially characterized by the fact that it includes at least the steps of: (a) cold isostatic compaction of pre-mixed powders 5, and of (b) uniaxial hot pressing of compact 12 obtained in step (a).

These two steps make it possible to produce an MMC with improved mechanical properties at a lower cost.

Advantageously, the powders are dry mixed in a suitable mixer subjected to a gas under pressure containing a neutral gas and oxygen.

The dry mixing of the powders has the advantage of being more economical than a wet mixing process, and the presence of a neutral gas makes it possible to avoid the risks of explosion present during a dry mixing operation.

Preferably, the pressure in the mixer is between 15 and 25 mbar, the neutral gas is nitrogen, and the percentage of oxygen is regulated and between 5 and 10%.

Regulation of the percentage of oxygen makes it possible to limit the risks of explosion even further.

More preferably, the pressure in the mixer is 20 mbar, and the percentage of oxygen is 6%.

Preferably, powder mixture 5 is composed of an aluminum alloy reinforced by particles such as, for example, particles of silicon carbide, boron carbide, alumina, or any other ceramic material.

More preferably, powder mixture 5 contains 94.7 wt % aluminum, 4 wt % copper, 1.3 wt % magnesium and 15 vol % silicon carbide.

Furthermore, powder mixture 5 is subjected to a packing operation on a vibrating table before isostatic compaction step (a).

Also before isostatic compaction step (a), the gas possibly contained in the mixture of packed powders 5 can be evacuated by pumping in order to obtain a solid compact 12.

During the compaction step, compaction fluid 15 advantageously contains water and lubricating additives.

Preferably, the pressure of compaction fluid 15 is between 1500 and 4000 bar, and more preferably, the pressure is 2000 bar.

It is also possible to provide that the compact obtained in step (a) be subjected to a degassing operation at a temperature between 100 and 450° C., preferably 440° C.

Preferably, uniaxial hot pressing step (b) is carried out at a temperature between 400 and 600° C., preferably at a temperature of 450° C., and with an applied pressure between 1000 and 3000 bar, preferably 1800 bar.

Advantageously, billet 22 obtained in step (b) is hot extruded.

Very advantageously, the aluminum matrix composites are reinforced by particles of silicon carbide or any other ceramic particles such as boron carbide or alumina.

The invention also relates to billet 22 obtained by the process described in the preceding.

The invention moreover relates to a device for implementating step (a) of the process described in the preceding, which includes: latex sheath 1 in which powder mixture 5 is poured, perforated cylindrical container 2 in which latex sheath 1 is arranged, and some means of hermetic isolation 7, 10, 11 of powder mixture 5 contained in sheath 1, in which sheath 1, perforated container 2 and hermetic isolation means 7, 10, 11 form isostatic compaction device 14 which can be placed in compaction liquid 15 of the isostatic press in order to undergo the isostatic compaction step (a).

Advantageously, hermetic isolation means 7, 10, 11 at least include plug 7, made of an elastically deformable material, force fit into sheath 1.

Very advantageously, hermetic isolation means 7, 10, 11 include upper edge 10 of sheath 1 which is folded in the direction of the bottom of sheath 1, forming annular rim 11 which elastically rests against external surface 13*a* of lateral wall 13 of perforated container 2.

Preferably, sheath 1 and perforated container 2 are arranged in a removable manner in cylindrical container 3 before isostatic compaction step (a).

In this case, upper edge 10 of sheath 1 is folded in the direction of the bottom of sheath 1 and elastically rests against external surface 12*a* of lateral wall 12 of cylindrical container 3.

Furthermore, the device of the invention can have means 7*a* for producing a vacuum in sheath 1 in such a way that the gas contained in powder mixture 5 is evacuated before isostatic compaction step (a).

BRIEF DESCRIPTION OF THE DRAWINGS

The invention will be better understood, and other aims, advantages and characteristics of it will appear more clearly upon reading the following description, which is given in reference to the appended drawings that represent non-limiting embodiments of the device of the invention and in which:

FIG. 2 is a view in section along line II-II of FIG. 1 of the assembled device of FIG. 1;

FIG. 3 is an identical view of the device of FIG. 2 without the container and arranged like this in the isostatic press;

DETAILED DESCRIPTION

The embodiment presented hereafter is suitable in a non-limiting manner for the preparation of aluminum matrix composites reinforced by silicon carbide particles.

Powder mixture 5 combined beforehand, composed of 94.7 wt % aluminum, 4 wt % copper, 1.3 wt % magnesium and 15 vol % silicon carbide, is dry mixed in a ball mill or in a conventional powder mixer.

In order to avoid any risk of explosion during mixing of the powders, the surrounding atmosphere contains a neutral gas such as nitrogen at a pressure between 15 and 25 mbar, preferably 20 mbar, as well as oxygen in a percentage between 5 and 10%, preferably 6%.

Figure 1:
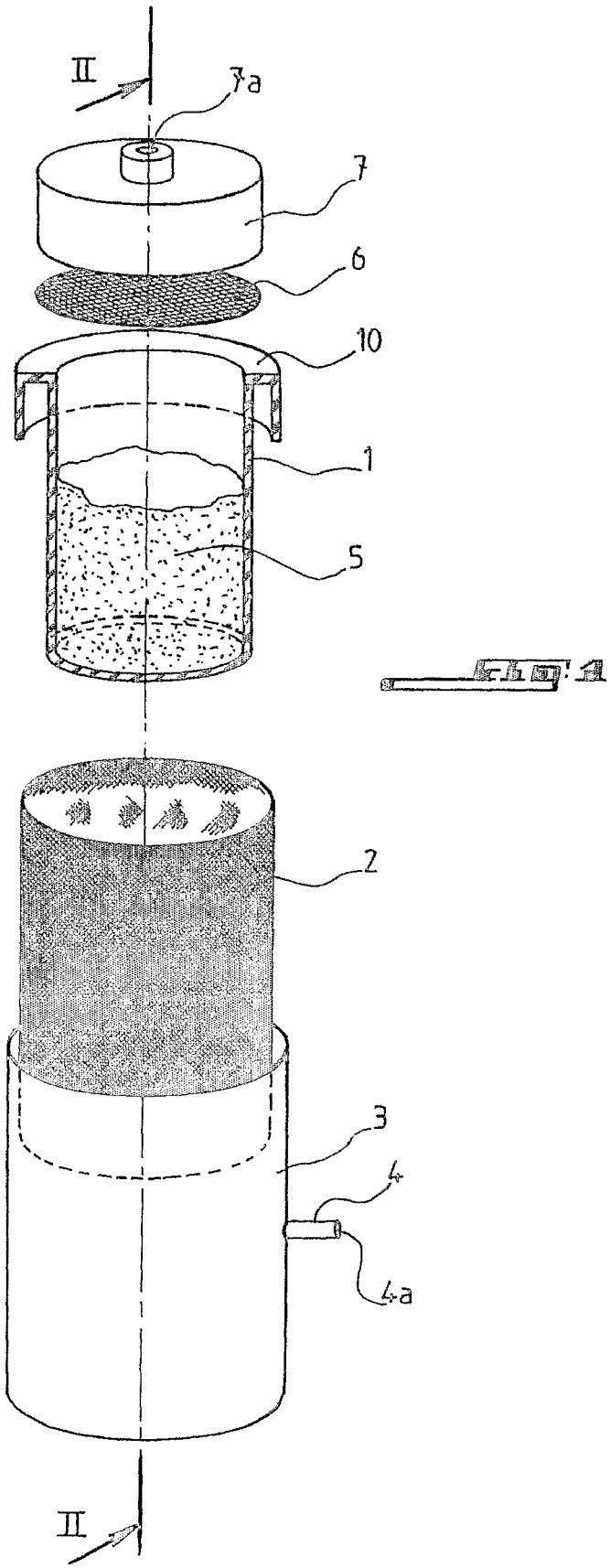
FIG. 1 is an exploded perspective view of the device of the invention making it possible to evacuate the residual gases before isostatic compaction step (a)

In reference to FIGS. 1 and 2, latex sheath 1 is arranged in perforated container 2 in such a way as to leave free space between the bottom of sheath 1 and the bottom of perforated container 2.

Latex sheath 1 and perforated container 2 are placed in container 3 which has nozzle 4 penetrated by channel 4*a* opening into container 3, said channel 4*a* being intended for connection to a vacuum pump via a pipe, which is not represented.

After hermetically closing off the device by some suitable means which is not represented, a slight vacuum is created at the site of nozzle 4 such that latex sheath 1 becomes flattened against the walls of perforated container 2, defining a volume with the largest possible capacity.

After application of the vacuum is stopped by closing channel 4*a*, the aforementioned powder mixture 5 is poured into sheath 1 and simultaneously packed in said sheath by means of a vibrating table, which is not represented.

In order to obtain optimal sealing for the operations which follow, upper part 10 of sheath 1 is arranged in such a way as to project from container 3 by being folded in the direction of the bottom of sheath 1 in order to form annular edge 11 which bears elastically against external surface 12*a* of lateral wall 12 of container 3.

Approximately cylindrical nitrile rubber plug 7 is force fit into sheath 1 while allowing annular edge 11 to project as described in the preceding.

The arrangement of nitrile rubber plug 7 and that of annular edge 11 of sheath 1 make it possible to obtain a completely sealed system.

Nitrile rubber plug 7 has central bore 7*a* intended for connection to a vacuum pump by means of a pipe, which is not represented.

A vacuum is effected until powder mixture 5 becomes solid compact 12; then vacuum application is stopped by closing off channel 7*a* by means of closure valve 7*b*.

Filter 6, attached on internal surface 9 of plug 7 and in contact with packed powder mixture 5, makes it possible to prevent dust from powder mixture 5 from entering the system for applying a vacuum during the drawdown.

In reference to FIG. 3, the assembly that forms device 14 for isostatic compaction, consisting of compact 12, sheath 1, perforated container 2 and plug 7, is extracted from container 3, the seal being preserved by the elasticity of sheath 1, making it possible, simultaneously with the extraction of this device 14 from container 3, for annular edge 11 to flatten against external surface 13*a* of lateral wall 13 of perforated container 2.

This device 14 is immersed in compaction liquid 15 of isostatic press 16 containing water and lubricating additives, and is thus subjected to the operation of cold isostatic compaction by application of a pressure between 1500 and 4000 bar, and preferably 2000 bar.

The speed of the pressure rise during this step is between 20 and 50 bar per minute, and the time for which the aforementioned maximum pressure is maintained is at least one minute.

In this way, the forces exerted on compact 12 are exerted over its whole surface, making it possible to obtain uniform compaction without forming strata or other discontinuities of the material.

Compact 12 obtained after the isostatic compaction operation has a density of approximately 85%.

After this operation, sheath 1 is extracted from perforated container 2, and the outside of sheath 1 as well as plug 7 are thoroughly cleaned in order to avoid any contact between compaction liquid 15 and compact 12.

Then, sheath 1 and plug 7 are removed, and the residues of filter 9 are removed by grinding or polishing the upper part of compact 12, if necessary.

Figure 4:
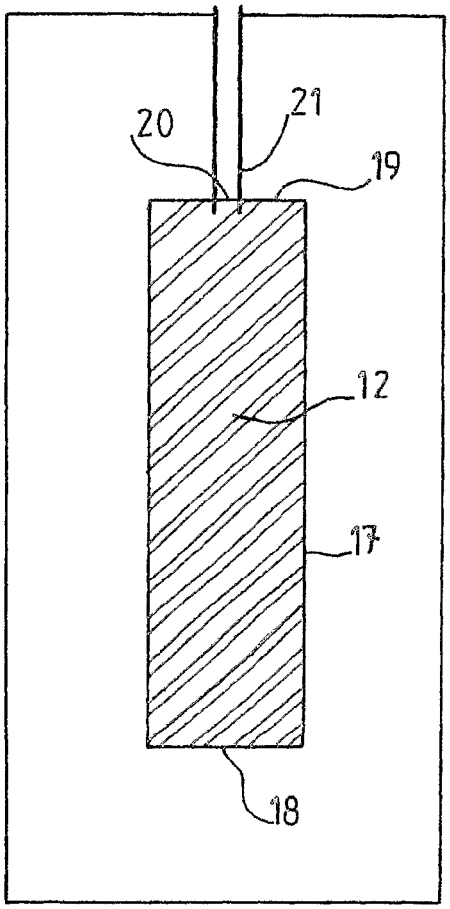
FIG. 4 is a view of the device during the degassing step.
Figure 5:
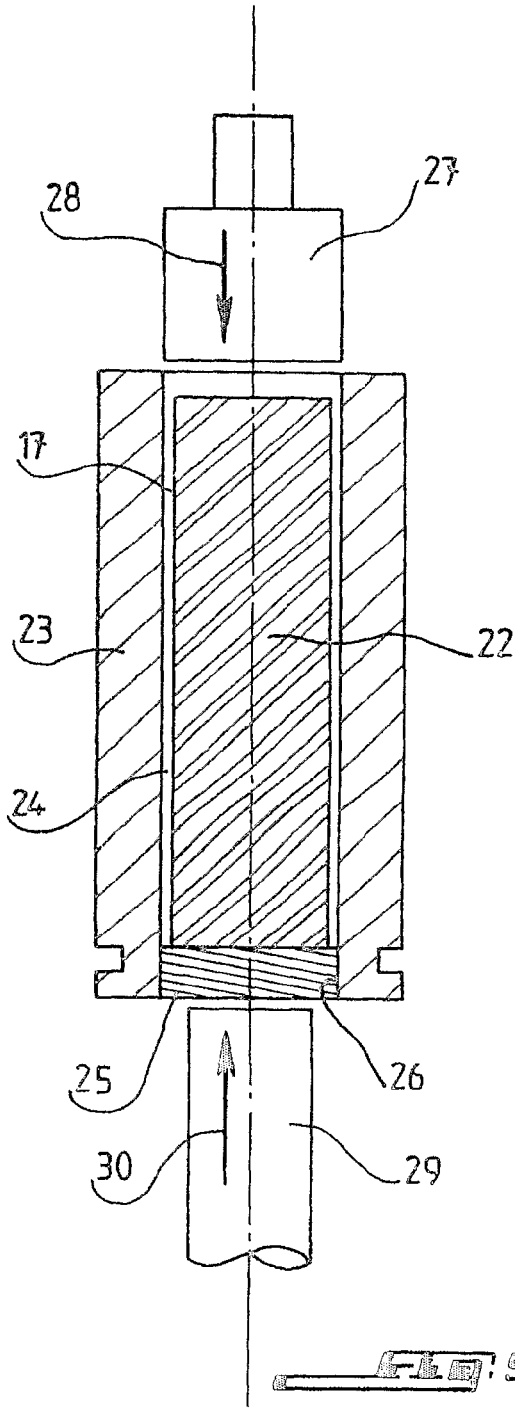
FIG. 5 is a view in section of the uniaxial pressing device.

In reference to FIG. 4, compact 12 is then arranged in tubular container 17 made of aluminum which has bottom wall 18.

Container 17 is closed by soldering opposite upper wall 19 made of aluminum, which has opening 20 in which tube 21, intended for connection to a vacuum pump, is soldered.

A vacuum is created for approximately 30 min after having checked the sealing of aluminum container 17, and while continuing the pumping, container 17 is placed in an oven at approximately 440° C. for approximately 12 h in order to undergo a degassing operation.

After this last operation, tube 21 is closed approximately 10-20 cm from upper wall 19.

Aluminum container 17 containing compact 12 is then quickly placed in tool 23 pre-heated to a temperature higher than 300° C., preferably between 400 and 600° C., and advantageously 450° C., so that compact 12 does not cool down after the degassing step.

The aforementioned temperature is maintained for the duration of the uniaxial hot pressing operation.

Tool 23 has cylindrical central bore 24 whose diameter is approximately equal to the diameter of container 17 so that it is possible to insert container 17 in said bore 24.

For reasons explained subsequently, container 17 rests on a piece forming matrix ejector 25 that is firmly attached in a removable manner to internal surface 26 of central bore 24.

Punch 27 then applies a pressure between 1000 and 3000 bar, preferably 1800 bar, onto container 22 in the vertical direction indicated by arrow 28 until punch 27 no longer moves, the pressure which is reached then being maintained for approximately one minute.

The application of a vertical pressure allows the matrix to be centered relative to this pressure.

After the uniaxial pressing operation, punch 27 is withdrawn, and billet 22, consisting of compact 12 in aluminum container 17 after the uniaxial pressing operation, is ejected from tool 23 by ejector 29 arranged on the side opposite punch 27, by application of pressure in the direction of arrow 20.

The ejection of billet 22 through the upper part of the tool is made possible by movable matrix ejector 25, which slides in central bore 24.

Mechanical peeling is then carried out in order to remove the layer of aluminum of the container around billet 22.

After the uniaxial pressing operation, billet 22 with a density of 100% is obtained, This billet 22 is hot extruded at a temperature of approximately 400° C. in order to give it better cohesion and optimal mechanical properties.

Billet 22 can then be machined in order to produce a metallic part of any shape by forging, machining or any other known technique.

By the process which has been implemented, the particles of silicon carbide are uniformly distributed in the billet obtained, which thus has improved mechanical properties.

The properties of the metallic-matrix composite thus obtained depend on the nature of the aluminum matrix, on the percentage of particle reinforcement and on the heat treatment carried out on the product.

The rapture strength is typically greater than 500 MPa, and the Young's modulus is between 95 and 130 GPa for a reinforcement percentage varying between 15 and 40 vol %.

The fatigue stress limit at $10^7$ cycles is situated between 250 and 350 Mpa, having the consequence that the mechanical parts produced from this CCM prepared according to the process described in the preceding can have a service life multiplied by a factor of 10 compared to conventional materials.

The invention claimed is:

1. A process for preparation of metal-matrix composites, comprising dry mixing aluminum-based alloy powders in a suitable mixer subjected to a gas under pressure containing a neutral gas and oxygen, and (a) cold isostatic compacting the pre-mixed powders to form a compact, (b) degassing the compact obtained in (a) at a temperature between 100 and 450° C. for approximately 12 hours, (c) placing the degassed compact obtained in (b) in a tool pre-heated to a temperature higher than 300° C. so that the degassed compact does not cool after degassing, and (d) uniaxial hot pressing of the compact obtained in (c) while the temperature higher than 300° C. is maintained for the duration of the uniaxial hot pressing.

2. A process according to claim 1, wherein the pressure in the mixer is between 15 and 25 mbar, the neutral gas is nitrogen, and the process further comprises regulating an oxygen percentage, wherein the percentage of oxygen is between 5 and 10%.

3. A process according to claim 2, wherein the pressure in the mixer is 20 mbar and the percentage of oxygen is 6%.

4. A process according to claim 1, further comprising packing the powder mixture on a vibrating table before isostatic compaction (a).

5. A process according to claim 1, wherein before isostatic compaction (a), the gas contained in mixture of packed powders is evacuated by pumping in order to obtain a compact solid.

6. A process according to claim 1, wherein cold isostatic compacting includes immersing in compaction fluid containing water and lubricating additives.

7. A process according to claim 6, wherein the compaction fluid has a pressure between 1500 and 4000 bar.

8. A process according to claim 7, wherein the pressure of the compaction fluid is 2000 bar.

9. A process according to claim 1, wherein uniaxial hot pressing is carried out at a temperature between 400 and 600° C., and at a pressure between 1000 and 3000 bar.

10. A process according to claim 9, wherein uniaxial pressing is carried out at a temperature of 450° C. and at a pressure of 1800 bar.

11. A process according to claim 1, further comprising hot extruding a billet obtained in (d).

12. A process according to claim 1, further comprising reinforcing the aluminum matrix composites with particles of ceramic.

13. A process according to claim 1, wherein the powder mixture contains approximately 94.7 wt % aluminum, 4 wt % copper, 1.3 wt % magnesium and 15 vol % silicon carbide.

14. A process according to claim 1, wherein the compact obtained in (a) is degassed a temperature of 440° C.

15. A process according to claim 12, wherein the particles of ceramic are particles of silicon carbide, boron carbide, or alumina.

* * * * *